US011257456B2

(12) United States Patent
Cao et al.

(10) Patent No.: US 11,257,456 B2
(45) Date of Patent: Feb. 22, 2022

(54) PIXEL DRIVING CIRCUIT AND DISPLAY PANEL

(71) Applicant: WUHAN CHINA STAR OPTOELECTRONICS TECHNOLOGY CO., LTD, Wuhan (CN)

(72) Inventors: Haiming Cao, Wuhan (CN); Yanqing Guan, Wuhan (CN)

( * ) Notice: Subject to any disclaimer, the term of this patent is extended or adjusted under 35 U.S.C. 154(b) by 0 days.

(21) Appl. No.: 16/970,642

(22) PCT Filed: Jun. 24, 2020

(86) PCT No.: PCT/CN2020/097937

§ 371 (c)(1),
(2) Date: Aug. 18, 2020

(87) PCT Pub. No.: WO2021/248566

PCT Pub. Date: Dec. 16, 2021

(65) Prior Publication Data

US 2021/0383768 A1 Dec. 9, 2021

(30) Foreign Application Priority Data

Jun. 9, 2020 (CN) ..... 202010520257.5

(51) Int. Cl.
*G09G 3/36* (2006.01)

(52) U.S. Cl.
CPC ..... *G09G 3/3677* (2013.01); *G09G 3/3688* (2013.01); *G09G 2300/0852* (2013.01); *G09G 2310/08* (2013.01)

(58) Field of Classification Search
CPC ..... G09G 3/3677; G09G 3/3688; G09G 2300/0852; G09G 2310/08; G09G 2300/0439–0465
See application file for complete search history.

(56) References Cited

U.S. PATENT DOCUMENTS

| | | | | |
|---|---|---|---|---|
| 2012/0113080 | A1 | 5/2012 | Den Boer | |
| 2015/0346528 | A1 | 12/2015 | Ge et al. | |
| 2016/0329018 | A1 | 11/2016 | Yao | |
| 2017/0178580 | A1 | 6/2017 | Yamazaki | |
| 2018/0158848 | A1 | 6/2018 | Murai | |
| 2019/0051337 | A1* | 2/2019 | Jo | G09G 3/20 |
| 2020/0243030 | A1 | 7/2020 | Liao et al. | |

FOREIGN PATENT DOCUMENTS

| | | | |
|---|---|---|---|
| CN | 104809983 | A | 7/2015 |
| CN | 106597715 | A | 4/2017 |
| CN | 107621709 | A | 1/2018 |
| CN | 108172583 | A | 6/2018 |
| CN | 108877661 | A | 11/2018 |
| CN | 108898997 | A | 11/2018 |

* cited by examiner

*Primary Examiner* — Stephen G Sherman

(57) ABSTRACT

In a pixel driving circuit and a display panel provided, a first transistor or a second transistor is controlled to maintain that the first transistor or the second transistor is normally turned on. The one of the transistors that is normally turned on is coupled to a common terminal. The other of the transistors serves as a driving switch that receives a row scan signal and a data signal to charge a liquid crystal capacitor and a storage capacitor. Thus, when the pixel driving circuit is in the low-frequency state or the high-frequency state, the first transistor and the second transistor can alternately operate to satisfy different operating requirements.

12 Claims, 2 Drawing Sheets

PIXEL DRIVING CIRCUIT AND DISPLAY PANEL

FIELD OF INVENTION

The present disclosure relates to a technical field of displays, and more particularly to a pixel driving circuit and display panel.

BACKGROUND OF INVENTION

Currently, it is required that display technology be suitable for both high-frequency and low-frequency situations. Therefore, display panels not only have an advantage of smooth picture quality brought by high frequency, but also have an advantage of low power consumption brought by low frequency. Therefore, dynamic frame rate technology came into being. This technology can adjust refresh rates of display panels in real time, thereby satisfying both ultra-low frequency and ultra-high frequency display requirements. For low-frequency display requirements, because in a low-frequency state, a holding time of each frame is extended to several tens of times as long as the original, display panels are required to have strong image-holding ability. For high-frequency display requirements, because a charging time of each row of pixels is extremely short, display panels need to have strong charging ability. Also, if a high refresh rate is used for displaying static or low-speed object images, a problem of high logic power consumption of display panels occurs.

Traditional backplane technology may be technology such as amorphous silicon (a-Si) technology, low-temperature polysilicon (LTPS) technology, or indium gallium zinc oxide (IGZO) technology. Compared with a-Si technology, LTPS technology and IGZO technology are widely used because of higher mobility. Because LTPS technology has higher mobility and a smaller area occupied by a device than IGZO technology, LTPS technology has stronger charging ability and is more suitable for high-frequency applications. Because IGZO technology has better uniformity and lower leakage current than LTPS technology, IGZO technology is more power-saving, has better image-holding ability, and is more suitable for low-frequency applications. It is understandable that because traditional backplane technology is single-element limited, a performance advantage of traditional backplane technology is single-application limited, causing dynamic frame rate requirements to be impossible to meet.

Referring to FIG. 1, FIG. 1 is an existing pixel driving circuit with a one transistor-two capacitor (1T2C) structure. The circuit includes a driving switch T10, a storage capacitor Cst, and a liquid crystal capacitor Clc. The driving switch T10 has a gate receiving a current row gate line output signal G(n), a drain electrically coupled to one terminal of the storage capacitor Cst and one terminal of the liquid crystal capacitor Clc, and a source electrically coupled to a data line. The current row gate line output signal G(n) is sent to control switching of the driving switch T10. When T10 is turned on, the data line charges the liquid crystal capacitor Clc and the storage capacitor Cst to a required voltage. Then, T10 is turned off. The storage capacitor Cst is discharged to maintain a voltage of the liquid crystal capacitor Clc until a next refresh. When the 1T2C circuit operates, because the driving switch T10 can only be a single type of thin film transistor (TFT), and each type of TFT has its advantages and disadvantages, the 1T2C circuit is not suitable for the requirements of dynamic frame rate technology. Therefore, it is necessary to design a new pixel driving circuit that is suitable for dynamic frame rate technology.

SUMMARY OF INVENTION

A technical problem is as follows. In the present disclosure, a pixel driving circuit and a display panel is provided to solve the problem that the current traditional 1T2C circuit is not suitable for dynamic frame rate technology.

Technical solutions are as follows. In a first aspect, in the present disclosure, a pixel driving circuit is provided. The circuit includes a first transistor, a second transistor, a liquid crystal capacitor, and a storage capacitor. Each of the first transistor and the second transistor includes a source, a gate, and a drain. Each of the liquid crystal capacitor and the storage capacitor includes a first terminal and a second terminal.

The drain of the first transistor is electrically coupled to the first terminal of the liquid crystal capacitor and the first terminal of the storage capacitor. The drain of the second transistor is electrically coupled to the second terminal of the liquid crystal capacitor and the second terminal of the storage capacitor. The gate of the first transistor receives a normally one-level signal, the source of the first transistor receives a common signal, the gate of the second transistor receives a row scan signal, and the source of the second transistor receives a data signal; or the gate of the first transistor receives the row scan signal, the source of the first transistor receives the data signal, the gate of the second transistor receives a normally one-level signal, and the source of the second transistor receives the common signal.

In some embodiments, the first transistor is a low-temperature polysilicon (LTPS) thin film transistor (TFT), and the second transistor is an oxide semiconductor TFT.

The gate of the first transistor receives a first normally one-level signal, the source of the first transistor receives the common signal, and the drain of the first transistor is electrically coupled to the first terminal of the liquid crystal capacitor and the first terminal of the storage capacitor. The gate of the second transistor receives the row scan signal, the source of the second transistor receives the data signal, and the drain of the second transistor is electrically coupled to the second terminal of the liquid crystal capacitor and the second terminal of the storage capacitor.

In some embodiments, the gate of the first transistor receives the row scan signal, the source of the first transistor receives the data signal, and the drain of the first transistor is electrically coupled to the first terminal of the liquid crystal capacitor and the first terminal of the storage capacitor. The gate of the second transistor receives a second normally one-level signal, the source of the second transistor receives the common signal, and the drain of the second transistor is electrically coupled to the second terminal of the liquid crystal capacitor and the second terminal of the storage capacitor.

In some embodiments, when the pixel driving circuit operates in a low-frequency state, the first transistor is turned off and the second transistor is turned on. When the pixel driving circuit operates in a high-frequency state, the first transistor is turned on and the second transistor is turned off.

In some embodiments, if the first transistor is an N-type TFT, the first normally one-level signal is a high-level signal; and if the first transistor is a P-type TFT, the first normally one-level signal is a low-level signal.

In some embodiments, if the second transistor is an N-type TFT, the second normally one-level signal is a high-level signal; and if the second transistor is a P-type TFT, the second normally one-level signal is a low-level signal.

In some embodiments, the row scan signal is generated by a gate-on-array (GOA) circuit or a gate chip on film (COF).

In some embodiments, the data signal is generated by an external clock control chip.

In some embodiments, a refresh rate of the low-frequency state has a range including an ultra-low frequency of 1 to 5 Hz, and a refresh rate of the high-frequency state has a range including an ultra-high frequency of 120 to 360 Hz.

In a second aspect, in the present disclosure, a display panel is also provided. The display panel includes a pixel driving circuit including a first transistor, a second transistor, a liquid crystal capacitor, and a storage capacitor. Each of the first transistor and the second transistor includes a source, a gate, and a drain. Each of the liquid crystal capacitor and the storage capacitor includes a first terminal and a second terminal.

The drain of the first transistor is electrically coupled to the first terminal of the liquid crystal capacitor and the first terminal of the storage capacitor. The drain of the second transistor is electrically coupled to the second terminal of the liquid crystal capacitor and the second terminal of the storage capacitor.

The gate of the first transistor receives a normally one-level signal, the source of the first transistor receives a common signal, the gate of the second transistor receives a row scan signal, and the source of the second transistor receives a data signal; or the gate of the first transistor receives the row scan signal, the source of the first transistor receives the data signal, the gate of the second transistor receives a normally one-level signal, and the source of the second transistor receives the common signal.

In some embodiments, the first transistor is an LTPS TFT, and the second transistor is an oxide semiconductor TFT.

The gate of the first transistor receives a first normally one-level signal, the source of the first transistor receives the common signal, and the drain of the first transistor is electrically coupled to the first terminal of the liquid crystal capacitor and the first terminal of the storage capacitor.

The gate of the second transistor receives the row scan signal, the source of the second transistor receives the data signal, and the drain of the second transistor is electrically coupled to the second terminal of the liquid crystal capacitor and the second terminal of the storage capacitor.

In some embodiments, the gate of the first transistor receives the row scan signal, the source of the first transistor receives the data signal, and the drain of the first transistor is electrically coupled to the first terminal of the liquid crystal capacitor and the first terminal of the storage capacitor. The gate of the second transistor receives a second normally one-level signal, the source of the second transistor receives the common signal, and the drain of the second transistor is electrically coupled to the second terminal of the liquid crystal capacitor and the second terminal of the storage capacitor.

In some embodiments, when the pixel driving circuit operates in a low-frequency state, the first transistor is turned off and the second transistor is turned on. When the pixel driving circuit operates in a high-frequency state, the first transistor is turned on and the second transistor is turned off.

In some embodiments, if the first transistor is an N-type TFT, the first normally one-level signal is a high-level signal; and if the first transistor is a P-type TFT, the first normally one-level signal is a low-level signal.

In some embodiments, if the second transistor is an N-type TFT, the second normally one-level signal is a high-level signal; and if the second transistor is a P-type TFT, the second normally one-level signal is a low-level signal.

In some embodiments, the row scan signal is generated by a GOA circuit or a gate COF.

In some embodiments, the data signal is generated by an external clock control chip.

In some embodiments, a refresh rate of the low-frequency state has a range including an ultra-low frequency of 1 to 5 Hz, and a refresh rate of the high-frequency state has a range including an ultra-high frequency of 120 to 360 Hz.

Advantageous effects are as follows. In the pixel driving circuit and the display panel provided in the present disclosure, the pixel driving circuit uses a two transistor-two capacitor (2T2C) circuit structure. A first transistor T1 or a second transistor T2 is controlled through a normally one-level signal to maintain that the first transistor T1 or the second transistor T2 is normally turned on. The one of the transistors that is normally turned on is coupled to a common terminal. The other of the transistors serves as a driving switch that receives the row scan signal and the data signal to charge the liquid crystal capacitor and the storage capacitor. Thus, when the pixel driving circuit is in the low-frequency state or the high-frequency state, the first transistor T1 and the second transistor T2 can alternately operate to satisfy different operating requirements.

DETAILED DESCRIPTION OF PREFERRED EMBODIMENTS

In order to make the objects, technical solutions, and advantages of the present disclosure more clearly, the present disclosure is further described in detail below with embodiments with reference to the accompanying drawings. It is understood that the specific embodiments described herein are merely illustrative of the present disclosure and are not intended to limit the present disclosure.

In all embodiments of the present disclosure, two electrodes other than a gate of a transistor are distinguished. One of the electrodes is referred to as a source and the other of the electrodes is referred to as a drain. Because the source and the drain of the transistor are symmetrical, the source and the drain are interchangeable. According to forms in the figures, it is stipulated that a middle terminal of the transistor is the gate, a signal input terminal is the source, and the signal output terminal is the drain. In addition, transistors used in all the embodiments of the present disclosure can include a P-type transistor and/or an N-type transistor. The P-type transistor is turned on when a gate is at a low potential and turned off when the gate is at a high potential. The N-type transistor is turned on when a gate is at a high potential and turned off when the gate is at a low potential.

Figure 1:
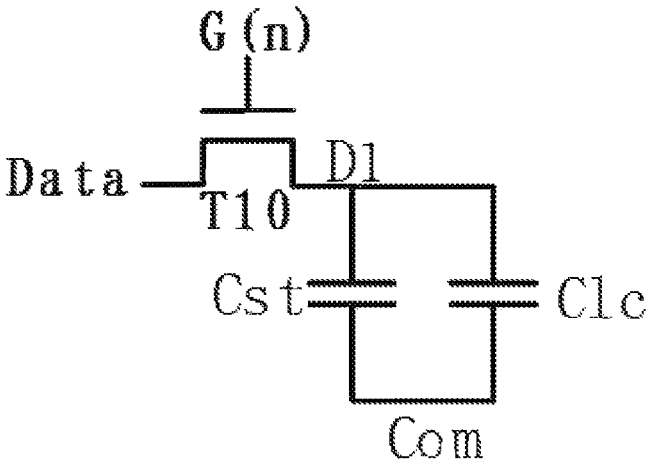
FIG. 1 (Related Art)
FIG. 1 is a diagram of an existing pixel driving circuit with a one transistor-two capacitor (1T2C) structure.
Figure 2:
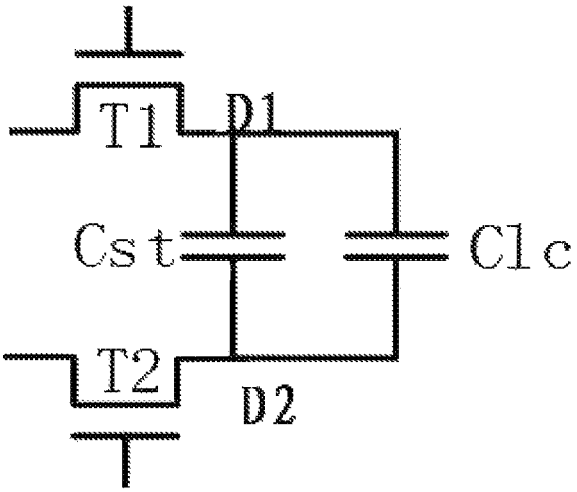
FIG. 2 is a diagram of a pixel driving circuit with a two transistor-two capacitor (2T2C) structure according to an embodiment of the present disclosure.

Referring to FIG. 2, FIG. 2 is a diagram of a pixel driving circuit with a two transistor-two capacitor (2T2C) structure according to an embodiment of the present disclosure. The pixel driving circuit includes a first transistor T1, a second transistor T2, a liquid crystal capacitor Clc, and a storage capacitor Cst. Each of the first transistor T1 and the second transistor T2 includes a source, a gate, and a drain. Each of the liquid crystal capacitor Clc and the storage capacitor Cst includes a first terminal D1 and a second terminal D2.

The drain of the first transistor T1 is electrically coupled to the first terminal D1 of the liquid crystal capacitor Clc and the first terminal D1 of the storage capacitor Cst. The drain of the second transistor T2 is electrically coupled to the second terminal D2 of the liquid crystal capacitor Clc and the second terminal D2 of the storage capacitor Cst. The gate of the first transistor T1 receives a normally one-level signal Gn (not illustrated in the figure and represented by a first normally one-level signal Gn1 or a second normally one-level signal Gn2 in the following embodiment), the source of the first transistor T1 receives a common signal Com, the gate of the second transistor T2 receives a row scan signal Kn, and the source of the second transistor T2 receives a data signal Data; or the gate of the first transistor T1 receives the row scan signal Kn, the source of the first transistor T1 receives the data signal Data, the gate of the second transistor T2 receives a normally one-level signal Gn, and the source of the second transistor T2 receives the common signal Com.

In the pixel driving circuit with the 2T2C circuit structure provided in the present disclosure, the first transistor T1 or the second transistor T2 is controlled through a normally one-level signal Gn to maintain that the first transistor T1 or the second transistor T2 is normally turned on. The gate of the first transistor T1 or the second transistor T2 receives the normally one-level signal Gn. The one of the transistors that is normally turned on receives the common signal Com. The other of the transistors serves as a driving switch that receives the row scan signal Kn and the data signal Data to charge the liquid crystal capacitor Clc and the storage capacitor Cst. Thus, when the pixel driving circuit is in the low-frequency state or the high-frequency state, the first transistor T1 and the second transistor T2 can alternately operate to satisfy different operating requirements.

It is understandable that the first transistor T1 and the second transistor T2 can be different types of thin film transistors (TFTs). For dynamic frame rate technology, it is required that a circuit be suitable for operating in both the low-frequency state and the high-frequency state. In order to satisfy requirements of dynamic frame rate technology, in the embodiment of the present disclosure, the first transistor T1 is a low-temperature polysilicon (LTPS) TFT, and the second transistor T2 is an indium gallium zinc oxide (IGZO) TFT.

In the following, the first transistor T1 is an LTPS TFT, and the second transistor T2 is an oxide semiconductor TFT. A specific process of applying the pixel driving circuit to operations in the low-frequency state or the high-frequency state is described in detail.

Figure 3:
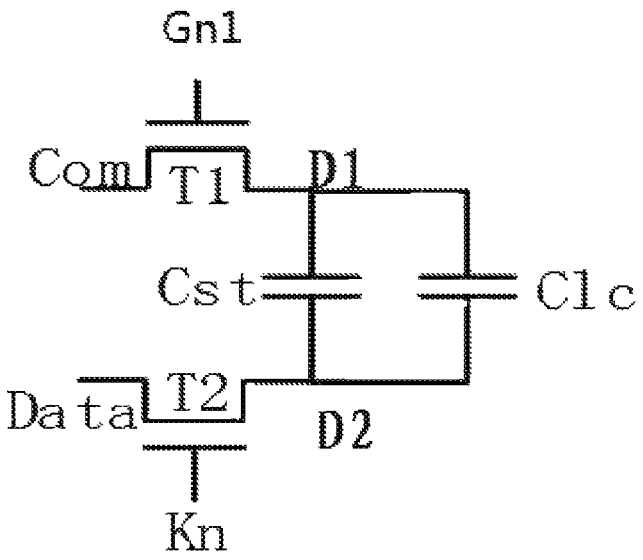
FIG. 3 is a diagram illustrating a connection relationship of the pixel driving circuit with the 2T2C structure in a low-frequency state according to an embodiment of the present disclosure.

Referring to FIG. 3, FIG. 3 is a diagram illustrating a connection relationship of the pixel driving circuit with the 2T2C structure in the low-frequency state according to the embodiment of the present disclosure. When the pixel driving circuit operates in the low-frequency state, the gate of the first transistor T1 receives the first normally one-level signal Gn1, the source of the first transistor T1 receives the common signal Com, and the drain of the first transistor T1 is electrically coupled to the first terminal D1 of the liquid crystal capacitor Clc and the first terminal D1 of the storage capacitor Cst. The gate of the second transistor T2 receives the row scan signal, the source of the second transistor T2 receives the data signal, and the drain of the second transistor T2 is electrically coupled to the second terminal D2 of the liquid crystal capacitor Clc and the second terminal D2 of the storage capacitor Cst.

When the pixel driving circuit operates in the low-frequency state, the first transistor T1 is normally turned on. It is understandable that if the first transistor T1 is an N-type TFT, the first normally one-level signal Gn1 is a high-level signal; and if the first transistor T1 is a P-type TFT, the first normally one-level signal Gn1 is a low-level signal. Here, it is taken as an example that the first transistor T1 is an N-type TFT.

During this time, the second transistor T2 is the driving switch responsible for writing the data signal. The first transistor T1 is a normally turned on switch responsible for maintaining that a node D1 is at a level of a common terminal. That is, the gate of the second transistor T2 receives the row scan signal, the source of the second transistor T2 receives the data signal, the gate of the first transistor T1 receives the first normally one-level signal Gn1, and the source of the first transistor T1 receives the common signal Com.

In this driving manner, the pixel driving circuit charges the storage capacitor Cst and the liquid crystal capacitor Clc to write data through leakage of the second transistor T2. Because the second transistor T2 is the oxide semiconductor TFT, a leakage current loff of the second transistor T2 is lower, improving a problem of insufficient image-holding ability in the low-frequency state.

Figure 4:
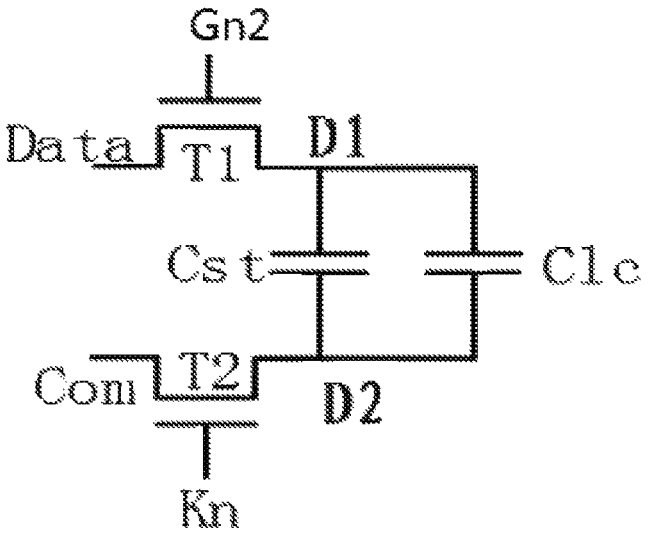
FIG. 4 is a diagram illustrating a connection relationship of the pixel driving circuit with the 2T2C structure in a high-frequency state according to an embodiment of the present disclosure.

Referring to FIG. 4, FIG. 4 is a diagram illustrating a connection relationship of the pixel driving circuit with the 2T2C structure in the high-frequency state according to the embodiment of the present disclosure. When the pixel driving circuit operates in the high-frequency state, the gate of the first transistor T1 receives the row scan signal Kn, the source of the first transistor T1 receives the data signal Data, and the drain of the first transistor T1 is electrically coupled to the first terminal D1 of the liquid crystal capacitor Clc and the first terminal D1 of the storage capacitor Cst. The gate of the second transistor T2 receives the second normally one-level signal Gn2, the source of the second transistor T2 receives the common signal Com, and the drain of the second transistor T2 is electrically coupled to the second terminal D2 of the liquid crystal capacitor Clc and the second terminal D2 of the storage capacitor Cst.

When the pixel driving circuit operates in the high-frequency state, the second transistor T2 is normally turned on. It can also be understandable that if the second transistor T2 is an N-type TFT, the second normally one-level signal Gn2 is a high-level signal; and if the second transistor T2 is a P-type TFT, the second normally one-level signal Gn2 is a low-level signal. Here, it is taken as an example that the second transistor T2 is also an N-type TFT.

During this time, the first transistor T1 is the driving switch responsible for writing the data signal Data. The second transistor T2 is a normally turned on switch responsible for maintaining that a node D2 is at a level of a common terminal. That is, the gate of the first transistor T1 receives the row scan signal Kn, and the source of the first transistor T1 receives the data signal Data. During this time, the gate of the second transistor T2 receives the second normally one-level signal Gn2, and the source of the second transistor T2 receives the common signal Com.

In this driving manner, the pixel driving circuit charges the storage capacitor Cst and the liquid crystal capacitor Clc to write data through leakage of the first transistor T1. Because the first transistor T1 is the LTPS TFT, which has higher mobility, charging ability of the first transistor T1 is stronger, improving a problem of insufficient charging ability in the high-frequency state.

The pixel driving circuit uses the 2T2C circuit structure. Connection relationships of an external scan line and an external data line are switched between the internal first transistor T1 and the internal second transistor T2 in response to a state being the high-frequency state or the low-frequency state. Thus, the second transistor T2, i.e., the oxide semiconductor TFT, is used to write the data in the low-frequency state. The first transistor T1, i.e., the LTPS TFT, is used to write the data in the high-frequency state. Thus, in the low-frequency state, advantages that the oxide semiconductor TFT has lower leakage current and lower leakage current loff, is more power-saving, and has stronger image-holding ability are used. Disadvantages that an LTPS TFT has higher leakage current loff and has a weak image-holding ability are avoided. In the high-frequency state, advantages that the LTPS TFT has higher mobility and stronger charging ability are used. Disadvantages that an oxide semiconductor TFT has lower mobility and weaker charging ability are avoided.

The embodiment of the present disclosure can alternately operate in the low-frequency state and the high-frequency state. In the high-frequency state, the LTPS TFT serves as the driving switch so that its characteristic of higher mobility is used. In the low-frequency state, the oxide semiconductor TFT serves as the driving switch so that its characteristic of low leakage current loff is used. Thus, the problems of insufficient charging in the high-frequency state and severe leakage in the low-frequency state are solved, satisfying the requirements of dynamic frame rate technology.

It is understandable that the row scan signal is generated by a gate-on-array (GOA) circuit or a gate chip on film (COF). The data signal is generated by an external clock control chip.

It should be noted that a refresh rate of the low-frequency state has a range including an ultra-low frequency of 1 to 5 Hz, and a refresh rate of the high-frequency state has a range including an ultra-high frequency of 120 to 360 Hz. Thus, the requirements of dynamic frame rate technology are satisfied.

In an embodiment of the present disclosure, a display panel is also provided. The display panel includes the aforementioned pixel driving circuit. The display panel has a structure and advantageous effects same as the pixel driving circuit provided in the foregoing embodiment. Details of the structure and the advantageous effects of the pixel driving circuit have been described in the foregoing embodiment, and are omitted here.

In the foregoing embodiments, the description of each embodiment has respective focuses. For a part that is not described in detail in an embodiment, refer to corresponding related descriptions in other embodiments.

The description of the foregoing embodiments is only for facilitating understanding of the technical solutions of the present disclosure and the core ideas thereof. Persons of ordinary skill in the art should understand that the technical solution described in each of the foregoing embodiments can be modified, or at least one technical feature described in each of the foregoing embodiments can be replaced by at least one equivalent alternative. The modification or the at least one alternative should not cause the essence of the corresponding technical solution to depart from the scope of the technical solution of each embodiment of the present disclosure.

What is claimed is:

1. A pixel driving circuit, comprising: a first transistor, a second transistor, a liquid crystal capacitor, and a storage capacitor; wherein each of the first transistor and the second transistor comprises a source, a gate, and a drain; and wherein each of the liquid crystal capacitor and the storage capacitor comprises a first terminal and a second terminal;

wherein the drain of the first transistor is electrically coupled to the first terminal of the liquid crystal capacitor and the first terminal of the storage capacitor; wherein the drain of the second transistor is electrically coupled to the second terminal of the liquid crystal capacitor and the second terminal of the storage capacitor; and wherein the first transistor is a low-temperature polysilicon (LTPS) thin film transistor (TFT), and the second transistor is an oxide semiconductor TFT;

wherein when the pixel driving circuit operates in a low-frequency state, the gate of the first transistor receives a first normally one-level signal, the source of the first transistor receives a common signal, the gate of the second transistor receives a row scan signal, and the source of the second transistor receives a data signal, so that the first transistor is normally turned on and the second transistor is a driving switch; when the pixel driving circuit operates in a high-frequency state, the gate of the first transistor receives the row scan signal, the source of the first transistor receives the data signal, the gate of the second transistor receives a second normally one-level signal, and the source of the second transistor receives the common signal, so that the first transistor is a driving switch and the second transistor is normally turned on.

2. The pixel driving circuit of claim 1, wherein if the first transistor is an N-type TFT, the first normally one-level signal is a high-level signal; and if the first transistor is a P-type TFT, the first normally one-level signal is a low-level signal.

3. The pixel driving circuit of claim 1, wherein if the second transistor is an N-type TFT, the second normally one-level signal is a high-level signal; and if the second transistor is a P-type TFT, the second normally one-level signal is a low-level signal.

4. The pixel driving circuit of claim 1, wherein the row scan signal is generated by a gate-on-array (GOA) circuit or a gate chip on film (COF).

5. The pixel driving circuit of claim 1, wherein the data signal is generated by an external clock control chip.

6. The pixel driving circuit of claim 1, wherein a refresh rate of the low-frequency state has a range comprising an ultra-low frequency of 1 to 5 Hz, and a refresh rate of the high-frequency state has a range comprising an ultra-high frequency of 120 to 360 Hz.

7. A display panel, comprising a pixel driving circuit comprising: a first transistor, a second transistor, a liquid crystal capacitor, and a storage capacitor; wherein each of the first transistor and the second transistor comprises a source, a gate, and a drain; and wherein each of the liquid crystal capacitor and the storage capacitor comprises a first terminal and a second terminal;

wherein the drain of the first transistor is electrically coupled to the first terminal of the liquid crystal capacitor and the first terminal of the storage capacitor;

wherein the drain of the second transistor is electrically coupled to the second terminal of the liquid crystal capacitor and the second terminal of the storage capacitor; and wherein the first transistor is a low-temperature polysilicon (LTPS) thin film transistor (TFT), and the second transistor is an oxide semiconductor TFT;

wherein when the pixel driving circuit operates in a low-frequency state, the gate of the first transistor receives a first normally one-level signal, the source of the first transistor receives a common signal, the gate of the second transistor receives a row scan signal, and the source of the second transistor receives a data signal, so that the first transistor is normally turned on and the second transistor is a driving switch; when the pixel driving circuit operates in a high-frequency state, the gate of the first transistor receives the row scan signal, the source of the first transistor receives the data signal, the gate of the second transistor receives a second normally one-level signal, and the source of the second transistor receives the common signal so that the first transistor is a driving switch and the second transistor is normally turned on.

8. The display panel of claim 7, wherein:

if the first transistor is an N-type TFT, the first normally one-level signal is a high-level signal; and if the first transistor is a P-type TFT, the first normally one-level signal is a low-level signal.

9. The display panel of claim 7, wherein:

if the second transistor is an N-type TFT, the second normally one-level signal is a high-level signal; and if the second transistor is a P-type TFT, the second normally one-level signal is a low-level signal.

10. The display panel of claim 7, wherein the row scan signal is generated by a gate-on-array (GOA) circuit or a gate chip on film (COF).

11. The display panel of claim 7, wherein the data signal is generated by an external clock control chip.

12. The display panel of claim 7, wherein a refresh rate of the low-frequency state has a range comprising an ultra-low frequency of 1 to 5 Hz, and a refresh rate of the high-frequency state has a range comprising an ultra-high frequency of 120 to 360 Hz.

* * * * *